US006076222A

United States Patent [19]

Jolly

[11] Patent Number: 6,076,222

[45] Date of Patent: Jun. 20, 2000

[54] ATHLETIC SHOE CLEANER

[76] Inventor: William A. Jolly, 386 Deerwood Rd., Stoneville, N.C. 27048

[21] Appl. No.: 09/024,083

[22] Filed: Feb. 17, 1998

[51] Int. Cl.[7] ..... A46B 13/20

[52] U.S. Cl. ..... 15/161; 15/188

[58] Field of Search ..... 15/188, 187, 186, 15/160, 161, 217, 238, DIG. 5

[56] References Cited

U.S. PATENT DOCUMENTS

| | | | |
|---|---|---|---|
| D. 371,453 | 7/1996 | Deacon et al. . | |
| D. 372,355 | 8/1996 | Deacon et al. . | |
| D. 373,675 | 9/1996 | McMullin . | |
| D. 378,013 | 2/1997 | McMullin . | |
| D. 380,076 | 6/1997 | McMullin . | |
| D. 385,988 | 11/1997 | McMullin . | |
| D. 387,548 | 12/1997 | McMullin . | |
| 469,031 | 2/1892 | Post . | |
| 1,026,774 | 5/1912 | Schimper . | |
| 1,196,453 | 8/1916 | Hatfield . | |
| 1,698,005 | 1/1929 | Stanwood . | |
| 2,604,377 | 7/1952 | Eames | 15/217 |
| 3,028,617 | 4/1962 | Racina . | |
| 3,284,091 | 11/1966 | Spier . | |
| 3,747,150 | 7/1973 | Kozub . | |
| 3,826,518 | 7/1974 | Henning . | |
| 4,068,339 | 1/1978 | Maruyama et al. | 15/187 |
| 4,343,265 | 8/1982 | Belschner | 15/188 |
| 5,067,196 | 11/1991 | Chen | 15/238 |
| 5,259,129 | 11/1993 | Deacon et al. . | |
| 5,310,201 | 5/1994 | Routh . | |
| 5,367,793 | 11/1994 | Deacon et al. . | |
| 5,664,278 | 9/1997 | Reisman | 15/160 |

FOREIGN PATENT DOCUMENTS

| | | |
|---|---|---|
| 2577129A | 8/1986 | France . |
| 444494 | 1/1949 | Italy . |
| 196815 | 6/1938 | Switzerland . |
| 283308 | 1/1928 | United Kingdom . |
| 726943 | 3/1955 | United Kingdom . |
| 2232580A | 12/1990 | United Kingdom . |

OTHER PUBLICATIONS

Golf Business Publications web page; Softspikes: An Overview of the Product and the Issues, 1997 month unknown.

Softspikes; A History of Innovation and Leadership; retrieved from the internet; undated month, year unknown.

Chat Time Sports News; Soft spikes fast becoming commonplace for golfers; retrieved from the internet; dated Sep. 17, 1997.

The Hearst Corporation, Electric Times Union; Spikeless shoes are this season's golf trend; retrieved from the internet, Copyright 1997 month unknown.

GolfWeb; Kleet Kleen 2000, retrieved from the internet, Copyright 1994 month unknown.

Softwalk Compression Golf Spikes; retrieved from the internet, undated month year unknown.

Kirk–Othmer Encyclopedia of Chemical Technology, vol. 21, "Rubber, Natural", p. 577, month unknown 1997.

*Primary Examiner*—Robert J. Warden, Sr.
*Assistant Examiner*—Kaj K. Olsen
*Attorney, Agent, or Firm*—Rhodes & Mason, PLLC

[57] ABSTRACT

An athletic shoe cleaner for cleaning a shoe bottom, especially the bottom of a shoe having non-metal spikes. The athletic shoe cleaner includes a cleaning surface having a plurality of spaced apart rods, wherein each of the plurality of spaced apart rods is formed from a semi-rigid material. In the preferred embodiment, the cleaner includes a flexible base for supporting the rods and permitting the cleaner to be mounted to a surface such as a fender of a golf cart. Also, in the preferred embodiment, the base is generally round and the plurality of spaced apart rods are arranged in an overlapping and radially symmetrical fashion with respect to the center of the cleaner with the height of each of the plurality of spaced apart rods increasing from the outer edge to the center.

27 Claims, 3 Drawing Sheets

ATHLETIC SHOE CLEANER

BACKGROUND OF THE INVENTION (1) Field of the Invention

The present invention relates generally to athletic shoe cleaners and, more particularly, to a device for cleaning non-metal spiked golf shoes.

(2) Description of the Prior Art

Devices for cleaning the conventional metal spiked golf shoes are well known. For example, U.S. Pat. No. 3,028,617, issued to Racina, discloses a bristled brush that is attachable to a pull cart for a golf bag. Similarly, U.S. Pat. No. 3,747,150, issued to Kozub, discloses double-sided bristle brush that can be attached to the wheel of a golf club pull cart. Stationary bristle brushes that are mounted at ground level, with the bristles pointed upwardly are also well known. The state of the art of athletic shoe cleaning devices, and golf shoe cleaning devices particularly, is based on the predominant use of metal spiked golf shoes.

There is a trend, however, in the golf industry toward non-metal spiked golf shoes. There are several advantages associated with the traditional metal spiked golf shoe. They provide excellent stability during the golf swing. Traction during walking with metal spiked golf shoes is also excellent. The disadvantage of the metal spikes, however, is that they extensively damage golf greens, fairways and golf club facilities. The damage caused by metal spiked golf shoes increases golf course maintenance costs and effects the quality of the golf course play. Because of these problems associated with the use of metal spiked golf shoes, many golf facilities have banned metal spiked golf shoes. Thus, there was a need in the golf shoe art for a golf shoe that would provide stability and traction yet reduce the damage to golf greens, fairways and club facilities.

Golf shoe cleats for use in place of a standard metal spike, such as those disclosed in U.S. Pat. No. 5,367,793, issued to Deacon et al., are known to cause significantly less damage to golf greens, fairways and facilities than conventional metal spikes.

There are, however, still disadvantages associates with non-metal spiked golf shoes. One of the most significant disadvantages is the loss of the excellent stability and traction associated with metal spiked golf shoes. This loss of stability and traction is exacerbated by the tendency of grass, dirt and other debris to collect on the bottom sole of non-metal spiked golf shoes. This collection of grass, dirt and debris further reduces stability and traction, especially under wet conditions and hilly terrain.

Conventional golf shoe cleaners, such as those discussed above, have serious disadvantages with respect to cleaning non-metal spiked golf shoes. Conventional golf shoe cleaners generally consist of a plurality of brush bristles anchored in a base. One disadvantage of such a cleaner is that brush bristles are not sufficiently rigid to dislodge grass, dirt, leaves and other debris from the bottom sole of a non-metal spiked golf shoe.

Another disadvantage associated with using conventional golf shoe cleaners with non-metal spiked golf shoes is that the flexibility of the brush bristles causes unwanted spray of mud, dirt and debris during the cleaning of the bottom sole of the golf shoe. This unwanted spray of mud, dirt and debris can cause soiling of the golfer's apparel, pants and socks and other nearby objects.

A further disadvantage of conventional golf shoe cleaners is the difficulty involved in cleaning the bottom of a golf shoe, particularly a non-metal spiked golf shoe during play. For example, the brush disclosed in U.S. Pat. No. 3,747,150, issued to Kozub, requires a golfer to stand on one foot and to maintain balance while cleaning the bottom of the shoe on the other foot. If the golfer loses balance, he may fall and suffer injury and/or damage to equipment and apparel. Another disadvantage associated with conventional golf shoe cleaners is the relatively high cost of manufacturing golf shoe cleaners comprised of brush bristles.

Accordingly, there remains a need for a new and improved golf shoe cleaner that is sufficiently rigid to be able to remove grass, dirt and debris from the bottom of non-metal spiked golf shoes while, at the same time, reduces the unwanted spray of dirt and debris associated with conventional bristle type golf shoe cleaners and is inexpensive and easy to manufacture.

SUMMARY OF THE INVENTION

The present invention is directed to an athletic shoe cleaner for cleaning a shoe bottom, especially the bottom of a shoe having non-metal spikes. The athletic shoe cleaner includes a cleaning surface having a plurality of spaced apart rods, wherein each of the plurality of spaced apart rods is formed from a semi-rigid material. In the preferred embodiment, the cleaner includes a flexible base for supporting the rods and permitting the cleaner to be mounted to a surface such as a fender of a golf cart. Also, in the preferred embodiment, the base is generally round and the plurality of spaced apart rods are arranged in an overlapping and radially symmetrical fashion with respect to the center of the cleaner with the height of each of the plurality of spaced apart rods increasing from the outer edge to the center.

Accordingly, one aspect of the present invention is to provide an athletic shoe cleaner for cleaning a shoe bottom, the athletic shoe cleaner including a cleaning surface comprised of a plurality of spaced apart rods.

Another aspect of the present invention is to provide an athletic shoe cleaner for cleaning a shoe bottom, the athletic shoe cleaner including a cleaning surface comprised of a plurality of spaced apart rods, wherein each of the plurality of spaced apart rods is comprised of a semi-rigid material.

Still another aspect of the present invention is to provide an athletic shoe cleaner for cleaning a shoe bottom. The athletic shoe cleaner including: (a) a cleaning surface comprised of a plurality of spaced apart rods, wherein each of the plurality of spaced apart rods is comprised of a semi-rigid material; and (b) a flexible base for supporting the rods.

These and other aspects of the present invention will become apparent to those skilled in the art after a reading of the following description of the preferred embodiment when considered with the drawings.

BRIEF DESCRIPTION OF THE DRAWINGS

FIG. 2 is a bottom perspective of the athletic shoe cleaner shown in FIG. 1 illustrating an adhesive cavity for mounting the cleaner to a golf cart or the like;

DESCRIPTION OF THE PREFERRED EMBODIMENTS

Figure 1:
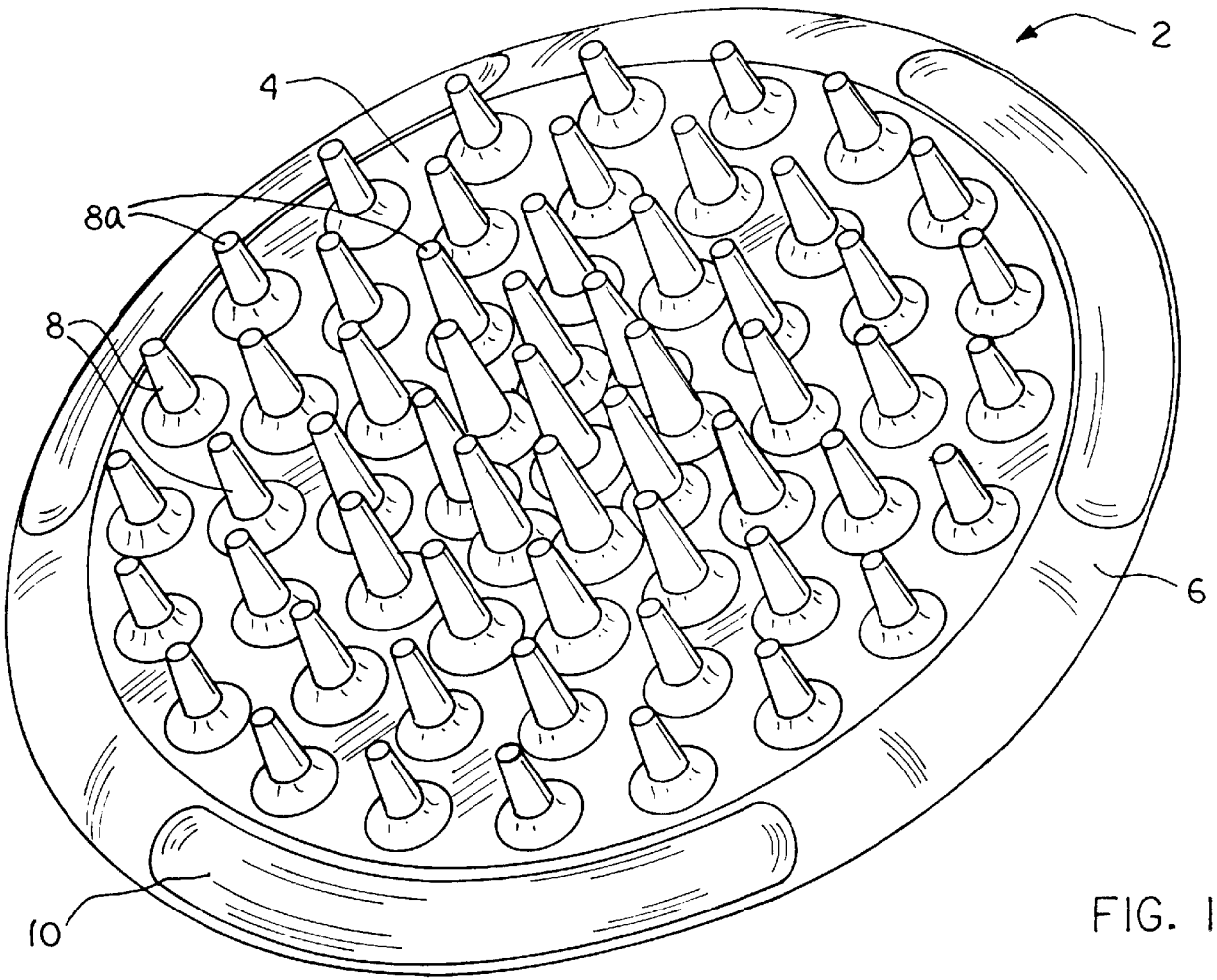
FIG. 1 is a front right perspective of an athletic shoe cleaner constructed according to the present invention;.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an athletic shoe cleaner for cleaning the bottom surface of an athletic shoe, generally designated 2, is shown constructed according to the present invention. By "bottom," it is meant the bottom of the shoe sole, which comes into contact with the ground. In the preferred embodiment, the athletic shoe cleaner 2 comprises a cleaning surface, generally designated 4, and a flexible base 6 adapted to allow the cleaner to be mounted onto the fender of a golf cart.

As shown in FIG. 1, the cleaning surface 4 is comprised of a plurality of the spaced apart rods 8 for cleaning dirt, mud, debris, grass and other foreign objects that may become lodged on the bottom of the shoe. The spacing between the rods permits easy removal of mud, dirt, debris and grass that has been dislodged from the shoe bottom, but remains lodged between the rods 8. It can be seen that the top side of the cavity defining lip 12 may include a plurality of indicia receiving regions 10 for displaying trademarks, logos and the like.

Figure 2:
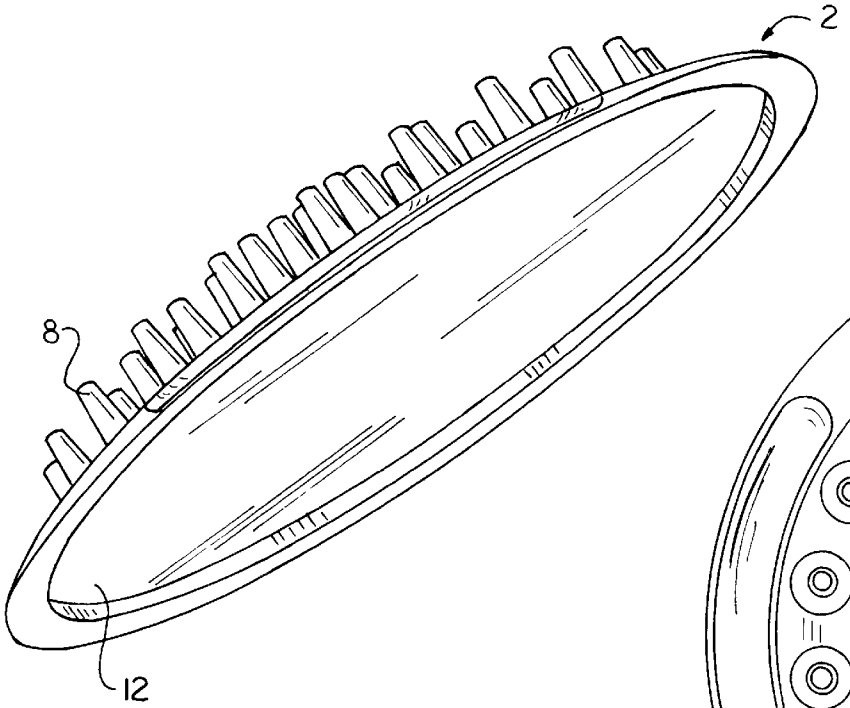

As best shown in FIG. 2, the bottom of the flexible base 6 includes a cavity defining lip 12 for receiving an adhesive for fixably attaching the athletic shoe cleaner 2 to an object, such as a golf cart fender.

Figure 3:
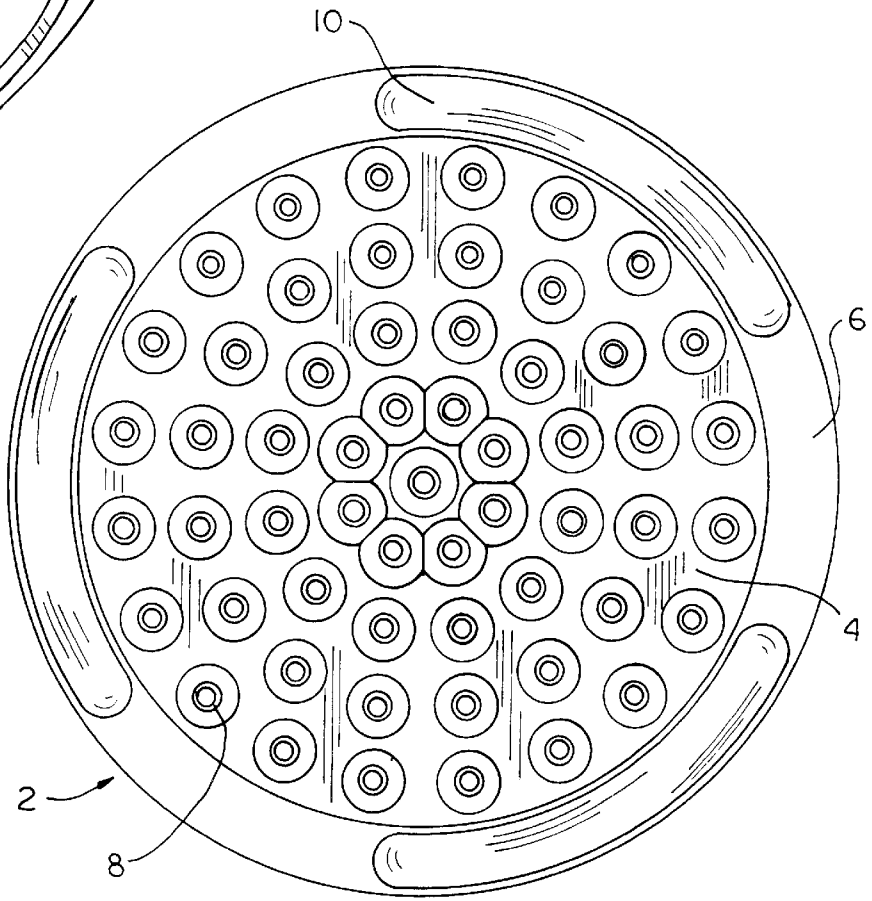
FIG. 3 is a top plan view of the athletic shoe cleaner illustrating the overlapping arrangement of the cleaning rods.

As best seen in FIG. 3, the plurality of spaced rods 8 are arranged in an overlapping, radially symmetrical fashion. Such an arrangement of the rods provides for better "cleaning action" than conventional bristle type cleaners where the bristles are arranged in straight rows and columns.

Figure 4:
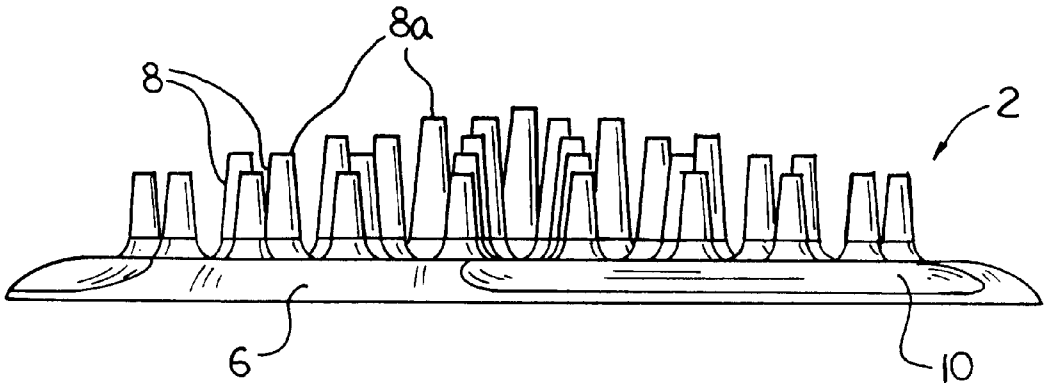
FIG. 4 is a side elevation view of the athletic shoe cleaner.

As best seen in FIG. 4, each rod 8 is oriented on an axis perpendicular to the plane of the flexible base 6. As also shown in FIG. 4, the relative height of each rod 8 increases in height from the outside edge of the flexible base 6 to the center of flexible base 6. The differences in the heights of the rods 8 allows the athletic shoe cleaner to effectively dislodge foreign objects from a shoe bottom regardless of where on the cleaning surface 4 the shoe bottom is placed.

Figure 5:
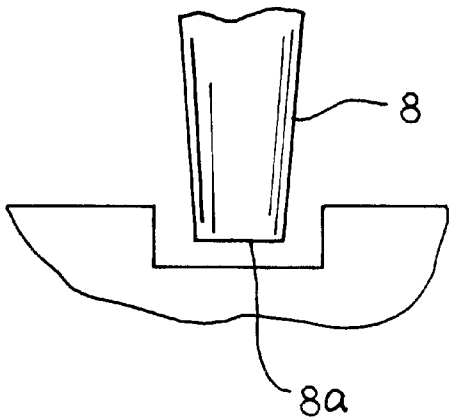
FIG. 5 is a cut away side view of an individual athletic shoe cleaner rod and a recess on an athletic shoe bottom.

As seen in FIG. 5, the top end 8*a* of each rod 8 is preferably truncated. The truncated top end 8*a*, as opposed to a pointed brush bristle, maximizes the contact of the cleaning surface of each rod. By "truncated," it is meant that the top end of each rod is flat or planar, as opposed to pointed.

Returning to FIG. 1, it can be seen that in the preferred embodiment, each rod 8 is tapered from the bottom end to the top end 8*a*. By "tapered" it is meant that the bottom end of the rod is wider than the top end of the rod. As seen in FIG. 5, tapering allows the rod end 8*a* to fit between the ridges of the shoe bottom while also providing a more rigid rod because of the greater thickness at the bottom end of the rod.

In the preferred embodiment, the plurality of spaced apart rods 8 are made of a semi-rigid material such as elastomeric rubber having a Shore Hardness value of greater than or equal to 80, with 100 being preferred. Such material is rigid enough to dislodge foreign objects from a shoe bottom, but not so rigid that the dislodged foreign objects are "sprayed" by the rapid "snapping" back of the rods to their original, upright position.

Each rod 8 is between about one-eighth (⅛) of an inch to one and one quarter inch in length as measured from the bottom end of the rod 8 to the top end 8*a* of the rod 8. In the most preferred embodiment, each rod 8 is between one-half inch and three-quarters of an inch in length, as measured from the bottom end of the rod 8 to the top end 8*a* of the rod 8. It has been found that rods less than about this height do not completely clean the bottom of the shoe. Rods greater than about this height clean but may cause unwanted spraying of debris.

The flexible base 6 is between about four inches to twelve inches wide, with six inches being preferred. The flexible base is comprised of elastomeric rubber with a Shore Hardness value of less than or equal to about 100. In the preferred embodiment, the flexible base 6 has at least five sides, with a round shape being preferred. Such a shape allows the athletic shoe cleaner to be easily mounted on an object, such as a golf cart fender, without the need to have the athletic shoe cleaner be leveled in order to be aesthetically acceptable.

In operation, the athletic shoe cleaner 2 is fixably attached to an object, such as the rear fender of a golf cart, so that the plurality of spaced apart rods 8 extend outwardly on axes perpendicular to the plane of the golf cart fender. To clean the shoe bottom, the golfer places the heel of the shoe upon the plurality of spaced apart rods of the mounted golf shoe cleaner 2. While pressing the shoe bottom against the plurality of spaced rods, the golfer scrapes or drags the shoe bottom across the top ends 8*a* of the plurality of the spaced apart rods 8. As the shoe bottom is scraped across the top ends 8*a* of plurality of the spaced apart rods 8, the rods 8 dislodge mud, dirt, debris, grass and any other foreign objects or materials that have adhered to the bottom of the golf shoe sole. The rods 8 are sufficiently rigid so that the dislodged objects or material are not sprayed on the golfer, the golfer's apparel, or other nearby objects and thereby soiling them. The golfer may repeat the scraping of the shoe bottom across the plurality of spaced apart rods 8 until the foreign objects and material that have adhered to the shoe bottom have been completely or nearly completely dislodged.

In the preferred embodiment, an athletic shoe cleaner is mounted on both the right and left fenders of a golf cart so that two golfers can simultaneously clean a shoe bottom.

In an alternate embodiment, the athletic shoe cleaner may be mounted on ground level stationary objects, nearby entrances to buildings and the like so that a golfer may clean the shoe bottom prior to entering the building.

Certain modifications and improvements will occur to those skilled in the art upon a reading of the foregoing description. By way of example, while elastomeric rubber is the preferred material, other resilient polymers such as urethane and polyethylene could also be used. It should be understood that all such modifications and improvements have been deleted herein for the sake of conciseness and readability but are properly within the scope of the following claims.

I claim:

1. An athletic shoe cleaner for cleaning a shoe bottom, said shoe cleaner including a cavity defining a lip for receiving an adhesive for mounting the athletic shoe cleaner onto a surface of an object and a cleaning surface comprised of a plurality of spaced apart rods, wherein the plurality of spaced apart rods is arranged in a plurality of concentric circumferential rows centered about a central point of the cleaner and wherein the plurality of rods in each of said circumferential rows is radially offset from the plurality of rods in each adjacent circumferential row.

2. The athletic shoe cleaner according to claim 1, further including a flexible base for supporting said rods.

3. The athletic shoe cleaner according to claim 2, wherein the flexible base is comprised of elastomeric rubber.

4. The athletic shoe cleaner according to claim 3, wherein the Shore Hardness value of the elastomeric rubber is less than or equal to about 100.

5. The athletic shoe cleaner according to claim 2, wherein the width of the flexible base is between about 4 inches and 12 inches.

6. The athletic shoe cleaner according to claim 5, wherein the width of the flexible base is about 6 inches.

7. The athletic shoe cleaner according to claim 2, wherein the flexible base has five or more sides.

8. The athletic shoe cleaner according to claim 2, wherein the flexible base is round.

9. The athletic shoe cleaner according to claim 2, further including an adhesive for mounting the athletic shoe cleaner onto a surface of an object.

10. The athletic shoe cleaner according to claim 2, further including at least one indicia receiving region.

11. An athletic shoe cleaner for cleaning a shoe bottom, said athletic shoe cleaner comprising:

(a) a cleaning surface comprised of a plurality of spaced apart rods, wherein the plurality of spaced apart rods is arranged in a plurality of concentric circumferential rows centered about a central point of the cleaner and wherein the plurality of rods in each of said concentric circumferential row is radially offset from the plurality of rods in each adjacent concentric circumferential row and wherein each of the plurality of spaced apart rods is comprised of a semi-rigid material; and (b) a flexible base for supporting said rods, said base including a cavity defining a lip for receiving an adhesive for mounting the athletic shoe cleaner onto a surface of an object.

12. The athletic shoe cleaner according to claim 11, wherein the flexible base is comprised of elastomeric rubber.

13. The athletic shoe cleaner according to claim 12, wherein the Shore Hardness value of the elastomeric rubber is less than or equal to about 100.

14. The athletic shoe cleaner according to claim 11, wherein the width of the flexible base is between about 4 inches and 12 inches.

15. The athletic shoe cleaner according to claim 14, wherein the width of the flexible base is about 6 inches.

16. The athletic shoe cleaner according to claim 11, wherein the flexible base has five or more sides.

17. The athletic shoe cleaner according to claim 11, wherein the flexible base is round.

18. The athletic shoe cleaner according to claim 11, further including an adhesive for mounting the athletic shoe cleaner onto a surface of an object.

19. The athletic shoe cleaner according to claim 11, further including at least one indicia receiving region.

20. The athletic shoe cleaner according to claim 11, wherein the semi-rigid material is elastomeric rubber.

21. The athletic shoe cleaner according to claim 20, wherein the Shore Hardness value of the elastomeric rubber is greater than or equal to about 80.

22. The athletic shoe cleaner according to claim 21, wherein the Shore Hardness value of the elastomeric rubber is about 100.

23. The athletic shoe cleaner according to claim 11, wherein the cleaning surface has an outer edge and a center, and the height of each of the plurality of spaced apart rods increases from the outer edge to the center.

24. The athletic shoe cleaner according to claim 11, wherein each of the plurality of spaced apart rods is between about ⅛ and 1-¼ inches in height.

25. The athletic shoe cleaner according to claim 24, wherein each of the plurality of spaced apart rods is between ½ and ¾ inches in height.

26. The athletic shoe cleaner according to claim 11, wherein each of the plurality of spaced apart rods has a top end and a bottom end, and wherein the top end is truncated.

27. The athletic shoe cleaner according to claim 11, wherein each of the plurality of spaced apart rods has a top end and a bottom end and wherein each of the plurality of spaced apart rods is tapered from the bottom end to the top end.

* * * * *